United States Patent [19]

Kustes et al.

[11] Patent Number: 4,861,236

[45] Date of Patent: Aug. 29, 1989

[54] BIROTATIONAL PUMP

[76] Inventors: Ryon Kustes; Alan M. Kustes, both of 4018 Contractors Ct., Louisville, Ky. 40213

[21] Appl. No.: 248,731

[22] Filed: Sep. 26, 1988

[51] Int. Cl.[4] ..... F04B 21/00

[52] U.S. Cl. ..... 417/315; 417/481

[58] Field of Search ..... 417/315, 481, 484, 510, 417/437

[56] References Cited

U.S. PATENT DOCUMENTS

| | | | |
|---|---|---|---|
| 1,452,718 | 4/1923 | Wilson | 417/481 |
| 1,531,333 | 3/1925 | Duffy | 417/510 |
| 1,951,607 | 3/1934 | Gideon | 417/481 |
| 2,100,318 | 11/1937 | Berhman et al. | 417/481 |
| 3,070,075 | 12/1962 | Hanselmann | 92/120 |
| 3,281,065 | 10/1966 | Chaffiotte | 417/484 |
| 3,765,805 | 10/1973 | Juhász | 418/68 |
| 4,406,121 | 9/1983 | Pelto | 60/330 |

FOREIGN PATENT DOCUMENTS

| | | | |
|---|---|---|---|
| 57-153902 | 9/1982 | Japan | 417/481 |
| 86916 | 7/1936 | Switzerland . | |

*Primary Examiner*—Carlton R. Croyle

*Assistant Examiner*—Robert N. Blackmon

*Attorney, Agent, or Firm*—Scott R. Cox

[57] ABSTRACT

This invention comprises a birotational pump for the movement of air fluid through a conventional pumping mechanism. It is comprised of cylindrical piston housing, a pump shaft running through the piston housing, a piston linkage assembly secured to the pump shaft, a pair of valve plates which cover the ends of the piston housing and a cylindrical pump housing surrounding the piston housing to allow for the free movement of the piston and piston linkage. This invention will permit the free flow of fluid or air through the piston housing by creating a suction chamber in the piston housing. The fluid enters the valve plates which contain openings which line up with openings in the piston housing. As the shaft rotates the openings on the first end of the piston housing cease to line up with openings in the piston housing and openings in the second end line up to expel the fluid contained within the chamber of the piston housing cirutier of rotation of shaft can be changed. Because of the unique arrangement of the piston housing and the rotational ring washers and their pins, the pump will operate to pump fluid regardless of the direction of rotation of the pump shaft.

9 Claims, 2 Drawing Sheets

BIROTATIONAL PUMP

BACKGROUND OF THE INVENTION

1. Field of Invention

This invention relates to pumps and, more particularly, to hydraulic or vacuum pumps for the movement of air or fluid through a pump with a birotational shaft.

2. Prior Art

The most widely used type of pump is the valve piston pump of which numerous constructions are known. Its disadvantages include the high cost of manufacture, the considerable work involved in carrying out repairs because of the valve and the associated crank mechanism which is necessary to convert the rotary movement piston mover into a rectangular reciprocating movement of the piston and the considerable space requirement.

A variety of rotary positive deplacement pumps not using a valve are known. Pumps having a single concentrically fitted rotor and a sliding valve seal have the disadvantages of a tendency to wear caused by the abrasive effect of the valve, the necessity for springs to be incorporated therein and, that the fluid path is along a single line. In addition, pumps with rotating valves and rotating blades display the appreciable effect of being liable to wear at their casing and blades because of the centrifugal forces acting on the blades.

U.S. Pat. No. 3,765,805 discloses a positive displacement double acting piston pump wherein the shaft drives the disk to which is pivotally secured a piston. The piston is connected to the pump casing, and on rotation of the disk, osculation of variable intensity occurs. The disk is sealed whereby the piston divides the casing into two chambers of variable volume. Fluid is displaced in this pump by rotation of the disk.

U.S. Pat. No. 4,406,121 discloses a rotary fluid device disclosing a multiple stage energized fluid flywheel contained within a housing. Pressurized fluid is discharged from the device to either a peripheral exhaust ring or an adjacent motor. The flywheel can operate using air, hydraulic fluid or other fluids.

U.S. Pat. No. 3,070,075 discloses a twin cylinder fluid motor with pendulum pistons. This motor acts as a hydraulic or pneumatic double acting twin cylinder motor.

A pump with a piston rod, construction is disclosed in Swiss Patent No. 86,916.

Hydraulic pumps as conventionally designed only pump fluid in one direction. While one directional shaft pumps are quite useful, great damages occurs to the pump if the direction of flow of the fluid is reversed. This reversal can cause the pump to burn out. Also, improper installation of a one directional pump can cause problems.

While some birotational pumps have been designed, they are complicated and suffer the additional problems of high cost and complicated design.

Accordingly, it is an object of this invention to produce a birotational pump for use in a hydraulic mechanism.

It is a further object of this invention to produce a birotational pump where no casting of the parts is required.

It is an additional object of this invention to product a fluid pump which is birotational.

It is a still further object of this invention to produce a birotational pump which is easy to repair, easy to manufacture and reliable.

These and other objects and features of the present invention will become apparent from a consideration of the following description and the accompanying drawings in which a selective example of the construction of the invention is set forth to illustrate the invention.

SUMMARY OF INVENTION

In accordance with the present invention there is provided a birotational fluid pump contained within a pump housing comprising:

(a) a cylindrical piston housing containing a plurality of openings both in the ends and in the rounded surface thereof;

(b) a pump shaft running through the piston housing wherein said pump shaft may rotate a full 360 degree in either direction within said piston housing;

(c) a piston linkage assembly secured to the pump shaft;

(d) a pair of valve plates which cover the ends of the piston housing containing openings which during the rotation of the piston shaft will line up with openings in the piston housing; and (e) a cylindrical pump housing surrounding the piston housing with an opening to allow for the rhythmic movement of the piston and piston linkage.

DETAILED DESCRIPTION OF INVENTION

Figure 1:
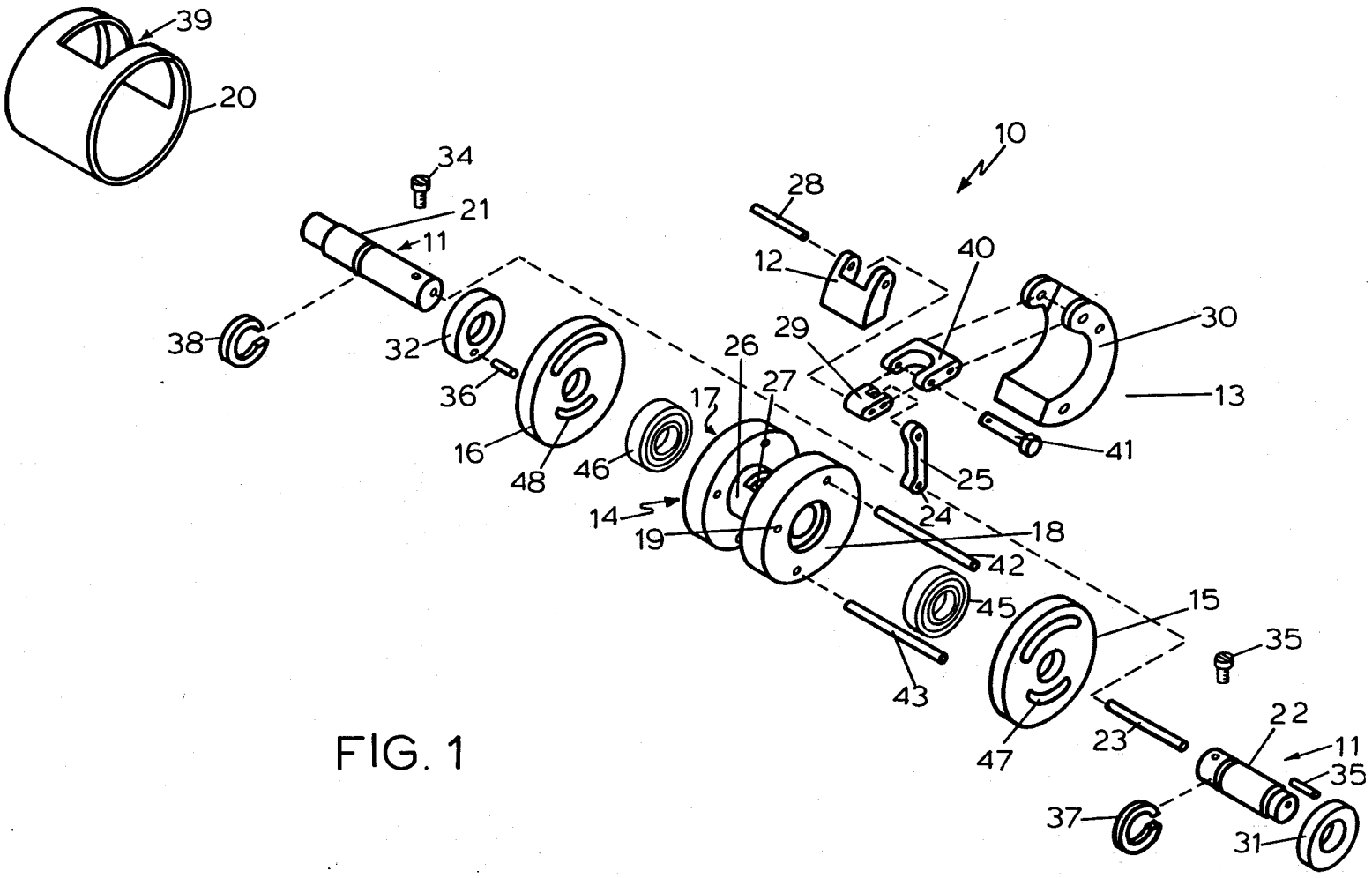
FIG. 1 is an exploded view of the birotational pump.

Although the invention is adaptable to a wide range of applications, it is shown in the drawings for the purpose of illustration as a birotational pump (10) comprising a pump shaft (11), a piston (12) with piston linkage (13) secured thereto, a piston housing (14) holding and securing the piston and piston linkage in place, a pair of valve plates (15, 16) attached to the end sections (17, 18) of the piston housing containing openings (19) in the ends through which the fluid or air may move from one end of the pump to the other end of the pump and a cylindrical pump housing (20) which surrounds the piston housing (14). See FIG. 1.

The pump shaft (11) is a conventional rotational pump shaft manufactured from conventional steel or stainless steel machine part quality material. The pump shaft is divided into two sections (21, 22) one at each end of the birotational pump. The two parts are secured together by a cam pin (23) inserted in openings in the inside end of each section of the pump shaft. This cam pin also passes through an opening (24) in a push rod (25) of the piston linkage. To operate the piston (12) the push rod (25) must move up and down. To accomplish this the cam pin (23) is secured in the openings in the ends of the pump shaft which are offset. The cam pin is secured within the ends of the sections of the pump shaft by conventional set screws (34, 35) passing through the outer surface of the sections of the pump shaft to be secured against the cam pin.

The pump shaft (11) rotates within the piston housing (14) and operates to move the piston (12) and piston linkage (13) within that housing. The unique feature of this pump is its ability to operate in both a clockwise and counter-clockwise rotation. Conventional pumps can operate in only one rotational direction. Should they be installed in a pump system incorrectly, they will not operate to pump the fluid through the system and any motor connected thereto. This can result in extensive damage to the pumping system and any motor connected thereto. In contrast, the pump of this invention will pump fluid when it rotates either clockwise or counter-clockwise, thus eliminating this potential problem.

The piston housing (14) is comprised of two end sections (17, 18) of a circumference sufficient to fit within the cylindrical pump housing (20) of the birotational pump. Between these two end sections is a middle section (26) inset from the two end sections containing a plurality of openings (27), each open to the pump shaft. The piston and piston linkage pass through these openings to allow the push rod of each piston linkage to interact with the cam pin (23). These openings allow the piston and piston linkage to be rotated by the pump shaft during its pumping operation. Secured within each end section of the piston housing are a pair of conventional ball-bearing rings (46, 45) to allow free rotation of the pump shaft within the piston housing.

Secured to the pump shaft and operating within and in conjunction with the piston housing is the piston (12) and piston linkage (13). While more than one piston and piston linkage may be operated in each piston housing, in a preferred embodiment a single piston and piston linkage apparatus is used.

Figure 2:
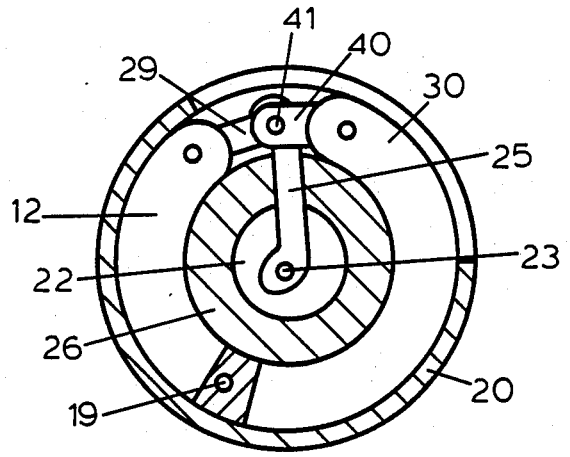
FIG. 2 is a sectional view of the pumping chamber and piston linkages of the birotational pump with the chamber with minimum capacity.
Figure 3:
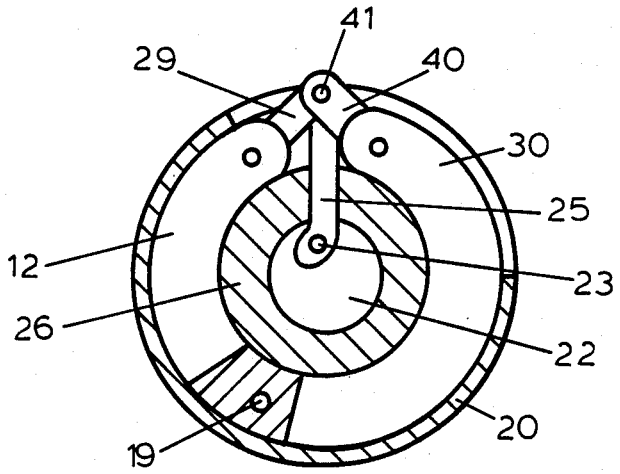
FIG. 3 is a sectional view of the pumping chamber and piston linkages of the birotational pump with the chamber with maximum capacity.

As previously discussed the piston (12) and piston linkage (13) are secured between opposing ends of the pump shaft by an offset cam pin (23) running through each end of the pump shaft and through the push rod of the piston linkage. As with any conventional piston arrangement, the offset cam rotates within the push rod (25) and moves the push rod in an up and down motion. See FIGS. 2 and 3. Attached to the push rod by a push rod pin (28) are a piston rod linkage (29) and the piston (12) which convey the up and down movement of the push rod to the piston. The piston is generally arch shaped and moves within the rotational arch of the middle section (26) of the piston housing. A second push rod linkage (40) is also attached to the push rod linkage (29) by a second push rod pin (41). This second push rod linkage is attached to a piston linkage support (30). The piston linkage support does not move as the piston is pushed up and down by the push rod and is secured to the piston housing by conventional securing means such as a pair of piston linkage support pins running through the housing and the piston linkage support (42, 43).

In the middle section of the piston housing, a chamber (not shown) is created between the end of the piston and the end of the piston housing. This chamber will contain the fluid or air which is pumped by operation of the pump. The capacity of this chamber will increase and decrease with the movement of the piston. As the push rod (25) rises, the piston (12) is pulled towards the push rod creating more space within the chamber. As the push rod retracts by operation of the pump shaft, the piston is pushed away from the push rod reducing the capacity of the chamber. See FIGS. 2 and 3.

At each end of the piston housing surrounding the pump shaft is a cylindrical valve plate (15, 16). Secured to the shaft (21) on the outer ends of each of these valve plates is a rotational ring washer (31, 32). These rotational ring washers are secured to the shaft by conventional securing means such as screws, bolts or pins (not shown) running through the ring washer into the shaft. Also assisting in the securing of these ring washers are securing washers (37, 38). Running through each of the rotational ring washers and into a half moon slot (47, 48) in each valve plate is a rotational ring washer pin (35, 36). Each of these pins rotate through the half moon slot to allow the valve plate to rotate. As the shaft rotates, the rotational ring washer pins also rotate in the half moon slots of the cylindrical valve plates. Once the pin reaches the end of the slot, it rotates the cylindrical valve plate in the direction of rotation allowing an opening (47) in the respective valve plates to match up with the openings (19) in the respective end section (18) of the piston housing. Because of the half moon shape of the slots, the cylindrical valve plates and the arrangement of openings in the valve plate and the piston housing, the openings will match up and allow the pumping of fluid through the pump regardless of the direction of rotation of the shaft. This provides a unique birotational pump arrangement permitting rotation in a clockwise and counter clockwise direction.

When the openings in the valve plate and the end section of the piston housing line up, the pumped fluid moves through the valve plate and through the end section of the piston housing into the chamber of the piston housing. The opposite valve plate will have openings (48) which will line up with openings in the opposite end section (17) of the piston housing to operate in a similar fashion. However, it is critical to the operation of the pump that the openings in one valve plate do not provide access to the chamber at the same time when the openings in the other valve plate provide access to the chamber. The size and location of the openings in the valve plate and the end section of the piston housing can be determined by experiment so as to allowing the appropriate amount of fluid to enter and leave the chamber of the piston.

The pump shaft piston housing and valve plates are all placed inside the cylindrical pump housing (20), which is then secured within the mechanism for movement of fluid. The rotational pump housing is provided with an aperture (39) through which the push rod, piston linkage and linkage support may move up and down without interfering with any cylindrical pump housing into which the birotational pump is placed. The cylindrical pump housing will contain an opening at each end through which the pump shaft is allowed to rotate.

In operation as the pump shaft (11) rotates it moves the push rod (25) up and down. As the push rod rises, the piston rod linkages (29, 40) act against the piston linkage (13) and the piston (12). The piston is rotated partially about the circumference of the middle section (26) of the piston housing and as it rotates, the chamber created between the ends of the piston linkage and the piston away from the push rod linkages increases and decreases. As the fluid, preferably oil, hits one valve plate (15), it is pulled through the slots (47) of the valve plate (15) and through the openings (19) in the end section (18) of the piston housing by the suction effect caused by the movement of the piston and the piston lineage in the chamber. As the chamber increases in capacity, the fluid is drawn into the chamber. See FIGS. 2 and 3. At the point of greatest capacity, the openings in the input valve plate (19) are closed by the failure of the opening in the valve plate and the end section of the piston housing to coincide. At the same point the slot (48) in the output valve plate (16) line up with opening (19) in the other end section of the piston housing do align, to allow the fluid in the chamber to be expelled from the chamber by the action of the piston and piston linkage support. The direction of fluid is always the same regardless of the rotation of the pump shaft. This is achieved by the coordination of the half moon slots, (47, 48) in the valve plates (15, 16) and the rotation ring washer pins (35, 36). The pins are secured to the rotation ring washer (31, 32) but not in the half moon slots in the valve plate, thus allowing rotation of the valve plates.

We claim:

1. A birotational pump contained within an outer body pump housing containing inlet and exit ports comprising:

(a) a cylindrical piston housing comprised of a pair of end sections and a middle section containing a plurality of openings both in the end sections and in the middle section thereof;

(b) a pump shaft running through the piston housing wherein said pump shaft may rotate a full 360 degrees in either direction within said piston housing;

(c) one or more piston linkage assemblies secured to the pump shaft;

(d) a piston secured to the piston linkage;

(e) an inlet and outlet valve plate which cover the ends of the piston housing containing openings which during the rotation of the piston shaft will line up with openings in the piston housing; and (f) a cylindrical pump housing surrounding the piston housing with an opening to allow for the rhythmic movement of the piston and piston linkage.

2. The birotational pump of claim 1 wherein the piston linkage assembly is comprised of a. a push rod secured to the pump shaft;

b. a pair of push rod linkages attached to the push rod;

c. a piston secured to one of the push rod linkages; and d. a piston linkage support secured to the other push rod linkage.

3. The birotational pump of claim 1 wherein the openings in the end sections of the piston housing line up with openings in the inlet end plate while the openings in the other end section of the piston housing line do not line up with the outlet end plate.

4. The birotational pump of claim 1 wherein the push rod is secured to the pump shaft by a cam secured in an offset position to the pump shaft.

5. The birotational pump of claim 1 wherein the respective ends of the piston and the piston linkage support act in conjunction with the piston housing to create a chamber in the piston housing.

6. The birotational pump of claim 1 wherein the valve plates are secured to the pump shaft by rotational ring washers assemblies.

7. The birotational pump of claim 1 wherein a single piston linkage assembly is secured to the pump shaft.

8. The birotational pump of claim 6 wherein the ring washer assembly is comprised of a rotational ring washer, securing washers and rotation ring washer pins.

9. The birotational pump of claim 6 wherein the rotational ring washer assemblies act in coordination with the inlet and outlet valve plates to permit the pumping of fluid through the birotational pump regardless of the direction of rotation of the pump shaft.

* * * * *